US005585531A

United States Patent [19]

Barker et al.

[11] Patent Number: 5,585,531

[45] Date of Patent: Dec. 17, 1996

[54] METHOD FOR PROCESSING LIQUID RADIOACTIVE WASTE

[76] Inventors: Tracy A. Barker, 108 Southwell Rd., Columbia, S.C. 29210; Robert T. Anderson, 121 Pine Island Rd., Columbia, S.C. 29212; Mark H. Kirshe, 52 Case St., North Canton, Conn. 06059

[21] Appl. No.: 319,736

[22] Filed: Oct. 7, 1994

[51] Int. Cl.[6] ..... G21F 9/00

[52] U.S. Cl. ..... 588/20; 210/650; 210/652; 976/DIG. 381

[58] Field of Search ..... 588/20; 210/682, 210/769, 770, 650, 652; 976/DIG. 381

[56] References Cited

U.S. PATENT DOCUMENTS

| | | | |
|---|---|---|---|
| 3,526,320 | 9/1970 | Kryzer . | |
| 3,632,505 | 1/1972 | Nelson . | |
| 3,654,148 | 4/1972 | Bradley . | |
| 3,757,005 | 4/1973 | Kautz et al. . | |
| 3,880,755 | 4/1975 | Thomas et al. | 210/91 |
| 3,973,987 | 8/1976 | Hewitt et al. | 134/12 |
| 4,105,556 | 8/1978 | D'Amaddio et al. | 210/152 |
| 4,107,044 | 8/1978 | Levendusky | 210/266 |
| 4,169,789 | 10/1979 | Lerat | 210/22 D |
| 4,188,291 | 2/1980 | Anderson | 210/23 H |
| 4,303,511 | 12/1981 | Schieder et al. | 210/724 |
| 4,409,137 | 10/1983 | Mergan et al. | 252/632 |
| 4,440,673 | 4/1984 | Ambros et al. | 252/632 |
| 4,482,481 | 11/1984 | Bandyopadhyay et al. | 252/628 |
| 4,569,787 | 2/1986 | Horiuchi et al. | 252/632 |
| 4,675,129 | 6/1987 | Baatz et al. | 252/633 |
| 4,761,295 | 8/1988 | Casey | 426/549 |
| 4,762,647 | 8/1988 | Smeltzer et al. | 252/632 |
| 4,800,042 | 1/1989 | Kurumada et al. | 252/628 |
| 4,983,302 | 1/1991 | Balint et al. | 210/638 |
| 5,066,371 | 11/1991 | De Voe et al. | 204/149 |

*Primary Examiner*—Ngoclan Mai
*Attorney, Agent, or Firm*—Banner & Allegretti, Ltd.

[57] ABSTRACT

A method is disclosed for treating liquid radioactive waste to provide reusable water, while reducing the overall volume and water content of the removed solid contaminants. The process is carried out in two separate stages, generally in at least two separate locations. In the first stage, the waste is pretreated at a first site, preferably where the waste was generated, to provide clean water, and a concentrated fraction containing removed suspended and dissolved solids, as well as some remaining water. The pretreatment typically involves passing the liquid waste through one or more microfilters, ultrafilter or nanofilters in combination with a reverse osmosis membrane. In the second stage of the process, the concentrated waste fraction, containing the removed solids, is transported to a second site, where it is thermally treated to remove the remaining water and reduce the volume of the remaining solids.

5 Claims, 1 Drawing Sheet

METHOD FOR PROCESSING LIQUID RADIOACTIVE WASTE

BACKGROUND OF THE INVENTION

1. Field of the Invention

This invention relates generally to the field of treating liquid radioactive waste, such as that produced by nuclear power plants. More particularly, the invention concerns a two-stage process for removing suspended and dissolved solids from low-level radioactive waste streams for permanent disposal. The process provides reusable water, while reducing the overall volume of the removed solid materials.

2. Background Art

In the nuclear power industry, the treatment of liquid radioactive waste is a very important concern. A typical nuclear power plant processes on the order of 10–20 million gallons of radioactive contaminated waste per year, from a number of different sources. The waste water typically includes process leakage water, water from process drains, water used to flush radioactive systems, and rain water leakage. To further complicate matters, the nature of the solid contaminants in the waste can vary greatly from one power plant to another.

If nuclear power is to continue as a viable energy option, the nuclear power industry must be able to efficiently and economically treat the liquid waste that it generates, so that the water in the waste can be reused, or disposed of in an economical manner. The industry must also be able to dispose of the removed solid contaminants in a safe, efficient manner. Since the cost of disposing of a given volume of solid waste is increasing greatly as more and more disposal sites are shut down, the volume of the solid waste must be decreased as much as possible before disposal.

Depending on the solids content of the liquid waste, two primary forms of treatment have typically been used. For liquid waste having a low solids content, filtration and reverse osmosis have been the preferred approach. For liquid waste having a high solids content, thermal evaporation has been the preferred approach. However, each of these approaches has significant drawbacks. For instance, the use of ion exchange demineralizers requires the disposal of large volumes of ion exchange resin or regeneration solution. Thermal evaporators, on the other hand, are very expensive to construct and operate. Evaporators are also very energy intensive, especially where the waste has a very low solids content. This can greatly increase customer power consumption costs. Evaporators have also experienced problems with heat transfer surface corrosion, which leads to expensive repairs and high radiation exposure to personnel.

Another approach has been to combine these various operations. For instance, U.S. Pat. No. 4,105,556 (D'Amaddio et al.) discloses an apparatus in which liquid radioactive waste is treated by filtration and reverse osmosis before introduction into an evaporator. However, in the system disclosed by D'Amaddio, all of the treatment steps are carried out at a single location, as part of an integrated continuous process. If the treatment is carried out at the power plant where the waste was generated, then the plant must have its own complete evaporator facility. On the other hand, if the treatment is carried out at a remote site, a great deal of effort and expense goes towards shipping large volumes of waste that is mostly water. Moreover, once the radioactive contaminants have been removed from the water at the remote site, the water must be shipped back to the plant to be reused.

In light of these and other deficiencies in prior art waste treatment systems, there is a need for a method of treating liquid radioactive waste that will provide reduced volumes of radioactive solids for disposal, while providing reusable water. There is also a need for a system of treating liquid radioactive waste that does not require each power station to have a costly evaporation system. There is also a need for a system for treating liquid radioactive waste that does not require the shipment of large amounts of liquid to a site where a thermal evaporator is available. These and a number of other objects are achieved by the present invention.

SUMMARY OF THE INVENTION

Figure 1:
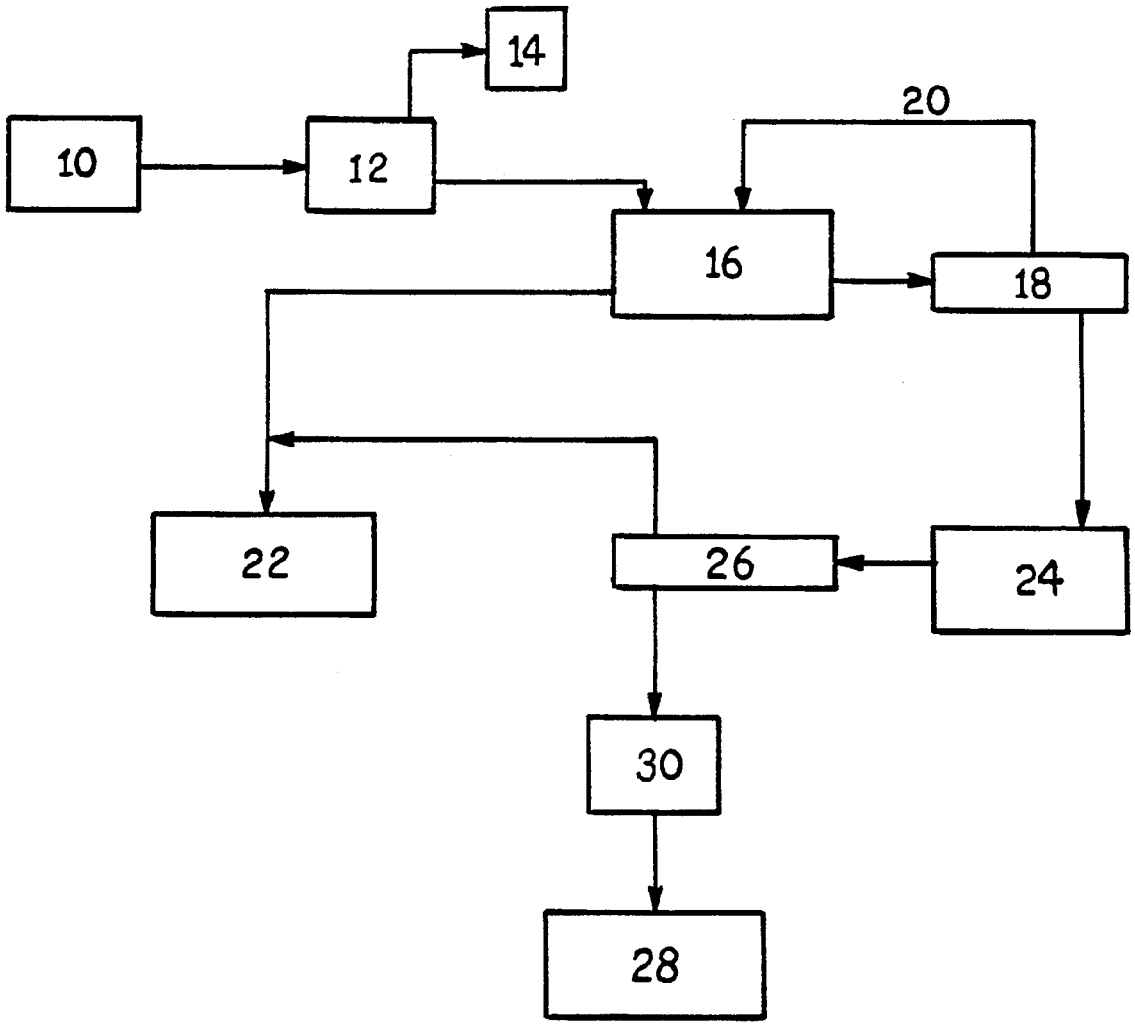
FIG. 1 is a diagrammatic flow sheet of the first stage of the liquid waste processing system.

In a basic aspect, the present invention is an improved process for treating liquid radioactive waste to provide reusable water, while reducing the overall volume and water content of the removed solid contaminants. The process is carried out in two separate stages, generally in at least two separate locations. In the first stage, the waste is pretreated at a first site, preferably where the waste was generated, to provide clean water, as well as a concentrated fraction containing removed suspended and dissolved solids, along with some remaining water. The pretreatment typically involves passing the liquid waste through one or more microfilters, ultrafilter or nanofilters in combination with a reverse osmosis membrane. In the second stage of the process, the concentrated waste fraction, containing the removed solids, is transported to a second site, where it is thermally treated to remove the remaining water and to further reduce the volume of the remaining solids prior to their disposal.

Since the thermal treatment stage of the process is carried out at a remote site, it is not necessary for each power plant to have an evaporator. Indeed, a single remote evaporator facility can be used to treat waste from a network or plurality of individual nuclear power stations, with the first stage operations being carried out at the individual stations, and the second stage operations being carried out at a single remote evaporator facility.

Through this process, the volume of the solid waste to be disposed of is reduced by a factor of as much as one hundred times. The final solid waste can also be made into a form that is suitable for either safe disposal or extended storage.

DETAILED DESCRIPTION OF THE PREFERRED EMBODIMENTS

As shown in FIG. 1, liquid radioactive waste is held in a corrosion resistant waste storage tank 10. The liquid waste is directed from the tank 10, into an oil separator 12, where insoluble organics, such as oil, are removed and collected in an oil collection vessel 14. The liquid waste stream that exits the oil separator 12 is then directed into a corrosion resistant filtration feed tank 16. Any oil or solids that are removed from the waste stream by the oil coalescer 12 are periodically batch transferred to a central collection vessel 22.

The liquid waste held in the filtration feed tank 16 is directed into a membrane filter system 18, to remove suspended solids. The filter system 18 may include a series of tubular membrane microfilters, ultrafilter and/or nanofilters, depending on the size of the suspended solids in the waste stream. A plurality of tubular membrane filters of equal porosity may also be used, to increase the overall surface area available for filtration.

Within the filtration system 18, the permeate from each individual filter is directed to the next filter in the series. At the same time, the concentrate from each filter, containing removed suspended solids, is recycled back into the filtration feed tank 16 for further filtration. The recycling operation allows the flow velocity across the membrane surface of each filter to be optimized, thereby increasing the membrane filtration efficiency. As more and more water is separated from the liquid waste with each pass through the filter system, the concentration of the solids in the filtration feed tank 16 will increase, as the liquid level in the tank decreases. Eventually, the solids concentration of the liquid waste in the feed tank 16 will increase to a point where further filtration is no longer practical. At that point, the concentrated contents of the feed tank 16 are transferred in a batch manner into the central collection vessel 22.

The liquid permeate that exits the final filter in the filter system 18, having been scrubbed of organics and suspended solids, is then directed to a corrosion resistant reverse osmosis feed tank 24. From there, it is directed into at least one reverse osmosis membrane 26 to remove dissolved solids. Again, the membrane is selected based on the size, quantity and nature of the dissolved solids, as well as the average size of any remaining suspended solids. The solids that are removed by the reverse osmosis membrane are transferred to the central collection tank 22.

The permeate from the reverse osmosis membranes, is directed to a clean water storage vessel 28. At this point, the liquid waste stream has been scrubbed of organic constituents, suspended solids, and dissolved solids. Clean water, suitable for reuse in a number of applications, has been produced. In a particularly preferred embodiment, the clean water may be further polished to a very high degree of purity with ion exchange resins or with a continuous deionization device 30, a form of electro-dialysis. This optional step will further increase the value of the clean water and increase the possibility of recycle or reuse.

These filtration and reverse osmosis steps concentrate the original liquid waste stream by typically two to three orders of magnitude. As a result, the flow into the collection vessel 22 will usually be quite slow. To take advantage of the time spent filling the collection vessel 22, the liquid in the vessel can be further concentrated as the vessel fills, through the use of an electrically heated brine concentrator. This is a small and simple low energy evaporator device.

It should be noted that all of the filters and membrane devices used in the first stage of the process are very modular, and are readily interchangeable with other types of equipment. In addition, the filters and membranes can be selected or modified, depending on the size and nature of the solid contaminants in the liquid waste, to enhance the efficacy of the process. Thus, the process can be readily adapted to meet the needs of particular power plants. Moreover, the equipment can be supported on a portable or movable platform, such as a truck or an enclosed van, and can be moved from power station to power station as the need arises.

At the end of the first stage of the process, most of the water has been separated away from the waste stream, leaving a concentrated slurry of suspended and dissolved solids. The concentrated waste is held in the collection vessel 22. However, the concentrate is not yet in condition for disposal, since it contains only 1% to 10% solids, with water as the remainder. Thus, before the solids can be disposed of legally and efficiently, it is necessary to further concentrate them by removing the remaining water.

Accordingly, in the second stage of the process, the concentrate from vessel 22 is transported to a remote site where an evaporator is located. The evaporator is preferably a thin film evaporator, which uses a rapidly rotating blade axially positioned within a heated cylindrical vessel. The rotating blade enhances the evaporation process and prevents harmful coating or clogging of the heated surfaces of the evaporator vessel. The concentrate is introduced into the evaporator, where the remaining water is driven off as a vapor and then condensed. The evaporator bottoms, made up of the removed solids, is then ready for final preparation prior to disposal. For instance, the dry solids can be directly compacted into a container, or encapsulated with a plastic such as polyethylene, or combined with a glass fit and processed in a glass furnace. The final waste form provides a structurally stable, inert and nonleachable solid that is suitable for ultimate disposal as a radioactive waste.

Various operational parameters of the process according to the present invention are illustrated by the following Example.

EXAMPLE

Four different liquid wastes, designated A, B, C and D, were each treated in accordance with the claimed invention. The characteristics of each liquid waste is listed in Table 1. Waste stream A had the most typical ranges of suspended solids, and dissolved solids and organic fluids. Waste streams B and C had relatively high concentrations of suspended solids and lesser quantities of dissolved solids. Waste stream C also had significant quantities of organic oil and other contaminants. Waste stream D had very high quantities of dissolved solids and relatively low quantities of suspended solids. These four waste streams are typical of the ranges of waters found at nuclear plants.

TABLE I

WASTEWATER CHARACTERISTICS

| | A | B | C | D |
|---|---|---|---|---|
| pH | 7.0 | 6.96 | 8.27 | 7.4 |
| Conductivity, μS/cm | 800 | 34.3 | 493 | 200 |
| TDS, ppm | 470 | 25 | 457 | 1200 |
| TSS, ppm | 40 | 250 | 1456 | 10 |
| Turbidity, NTU | not measured | 16 | 400 | not measured |
| Oil & Grease, ppm | 30 | 0 | ≈50 | 0 |
| Silica, ppm | 10 | 2.52 | 31.2 | 5.2 |
| Calcium, ppm | 10 | 3.4 | 17 | 0.01 |
| Magnesium, ppm | 15 | 0.6 | 1.60 | 1.0 |
| Chloride | 200 | 8.5 | 44 | 0.0 |
| Sulfate | 140 | 2.5 | 10 | 200 |
| Iron (Fe2+), ppm | 10 | 0.03 | 0.01 | 0.01 |

Tables 2 and 3 show the various components that were used to efficiently process each of the four waste streams in the first stage of the treatment. Typically, at least three of the components were used. The water was concentrated from 37.2 times (waste B) to 50.3 times (waste C). In addition, the clean permeate water was typically reduced to less than 1.0 ppm solids using the CDI system.

TABLE II

| FIRST STAGE COMPONENT USAGE | A | B | C | D |
|---|---|---|---|---|
| Oil/Water Separator | X | | X | |
| Membrane Filter - Micro | | | | X |
| Membrane Filter - Ultra | X | X | X | |
| Membrane Filter - Nano | | | | X |
| Membrane - Brackish R.O. | X | X | X | |
| Membrane - Seawater R.O. | X | | | |
| Membrane - CDI | | X | | X |

TABLE III

| LIQUID STREAM CHARACTERISTIC'S AFTER FIRST Stage OF PROCESS | A | B | C | D |
|---|---|---|---|---|
| Total suspended solids, permeate - ppm | 0.8 | 3.8 | 14.6 | 0.1 |
| Concentrate - ppm | 2,000 | 16,250 | 14,500 | 900 |
| Suspended solids concentration ratio | 50 | 65 | 100 | 90 |
| Total dissolved solids, permeate - ppm | 2.3 | 0.3 | 4.6 | 13.3 |
| Concentrate - ppm | 94,000 | 2,125 | 41,130 | 108,000 |
| Dissolved solids concentration ratio | 200 | 85 | 100 | 90 |
| Total concentration ratio - stage one | 40.2 | 37.2 | 50.3 | 47.4 |

At the end of the first stage of the process, the concentrate would be suitable for shipment to a remote site, for the second stage of the process. After the first stage of the process, the concentrate was treated in an evaporator to remove the remaining water. The evaporative processing is energy efficient, since the evaporator typically must remove only 1–2% or less of the initial water inventory. The evaporator concentrated the waste solution by an additional 10.8–82.5 times, as shown in Table 4. However, the total liquid concentration by both stages of the process varied from 545 to 3,070 times, when considering the original waste water volume. The remaining dry solid waste contained the vast proportion of the solids and radioactivity of the waste liquids originally processed.

TABLE IV

| SECOND STAGE CONDITIONS | A | B | C | D |
|---|---|---|---|---|
| Evaporator inlet, concentration - ppm | 20,010 | 10,210 | 93,300 | 51,900 |
| Evaporator outlet form | dry solid | dry solid | dry solid | dry solid |
| Evaporator concentration ratio | 47.5 | 82.5 | 10.8 | 19.3 |
| Total system (stage one, two) concentration ratio | 1910 | 3070 | 545 | 915 |

The above-described process concentrates radioactive liquids into a solid having a greatly reduced volume, thereby improving the disposal cost and potentially the safety of waste storage and disposal. The process also permits the recovery and reuse of clean water from waste water having a wide range of constituents, ranging from oils, other liquid organics, course and very fine suspended solids and all inorganic salts. The resulting water may be cleaned to any level of purity by adjusting the process parameters and by the use of an optional ion exchange device.

The process takes advantage of the modular and interchangeable nature of certain filtration processes, such as ultrafiltration and reverse osmosis, by performing those operations at the site where the waste was generated. At the same time, the process avoids the need to operate an expensive evaporator facility at each waste generation site.

While in the foregoing, there has been described a preferred embodiment of the claimed process, it should be understood to those skilled in the art that various modifications and changes can be made without departing from the true spirit and scope of the invention as recited in the claims.

What is claimed is:

1. A method for removing suspended and dissolved solid materials from a liquid radioactive waste stream to provide reusable water, while reducing the overall volume of the removed solid materials, the method comprising the steps of a) pretreating the liquid waste stream at a first site to remove suspended and dissolved solids from the waste stream, providing a reusable water fraction and a concentrated solids fraction containing at least some water, the pretreatment comprising passing the waste stream through a filtration system to provide a permeate and a concentrate that contains removed suspended solids, the concentrate from the filtration system being recycled back into the filtration system;

b) collecting the concentrated solids fraction;

c) transporting the concentrated solids fraction from the first site to a remote second site; and d) thermally treating the transported, collected concentrated solids fraction at the second site to further reduce the amount of water in the solids fraction and to reduce the volume of the collected solids fraction.

2. The method of claim 1, wherein the pretreatment further comprises directing the permeate from the filtration system into a reverse osmosis membrane.

3. The method of claim 2, comprising the further step of directing the permeate from the reverse osmosis membrane into a continuous deionization system.

4. The method of claim 1, wherein the thermal treatment of the collected solids fraction is carried out in an evaporator.

5. The method of claim 4, wherein the evaporator is a thin film evaporator.

* * * * *